US005671771A

United States Patent [19]

Brandel

[11] Patent Number: 5,671,771

[45] Date of Patent: Sep. 30, 1997

[54] HOT WATER SYSTEM

[76] Inventor: Charles F. Brandel, 2046 W. Avenue M-8, Palmdale, Calif. 93551

[21] Appl. No.: 521,625

[22] Filed: Aug. 31, 1995

Related U.S. Application Data

[63] Continuation-in-part of Ser. No. 394,967, Feb. 27, 1995, abandoned.

[51] Int. Cl.[6] ..... F16K 49/00

[52] U.S. Cl. ..... 137/337; 137/564; 137/893; 126/362

[58] Field of Search ..... 137/564, 337, 137/893, 894; 126/362

[56] References Cited

U.S. PATENT DOCUMENTS

| | | | |
|---|---|---|---|
| 1,377,714 | 5/1921 | Manning et al. | 126/362 |
| 1,974,816 | 9/1934 | Johnson | 126/362 |
| 2,915,080 | 12/1959 | Holmes | 137/337 |
| 2,953,160 | 9/1960 | Brazier | 137/893 |
| 3,285,241 | 11/1966 | Bordeaux | 126/362 |
| 3,870,228 | 3/1975 | Moseley | 126/362 |
| 3,929,153 | 12/1975 | Hasty | 137/564 |
| 4,257,355 | 3/1981 | Cook | 126/362 |
| 5,331,996 | 7/1994 | Ziehm | 137/337 |

FOREIGN PATENT DOCUMENTS

| | | | |
|---|---|---|---|
| 3403859 | 2/1984 | Germany . | |
| 49342 | 9/1931 | Norway | 137/894 |

*Primary Examiner*—A. Michael Chambers
*Attorney, Agent, or Firm*—Robert M. Sperry

[57] ABSTRACT

A hot water plumbing system comprising a water heater, a delivery location, a delivery line delivering water from said heater to said delivery location, a riser located adjacent said delivery location and extending upward above the level of said heater, and a return line connected adjacent the upper end of said riser and inclined so as to extend gradually downward to an input located adjacent the bottom of said heater to provide a continuous flow of hot water within the system, which ensures immediate and constant delivery of hot water to the delivery location and prevents accumulation of sediment within the system and, hence, minimizes installation and maintenance costs and significantly reduces the amount of wasted water. The system particularly employs a vacuum accelerator, which can be used to increase system vacuum and which causes rapid start-up or priming of the system. A three-way ball valve is further provided to control the diversion of incoming water from a supply line between the water tank and the vacuum accelerator. Water from the return line passes through the vacuum accelerator and then into the bottom of the water tank through a heater tank cleaning probe assembly. Once set up, the preferred system has no moving parts.

25 Claims, 6 Drawing Sheets

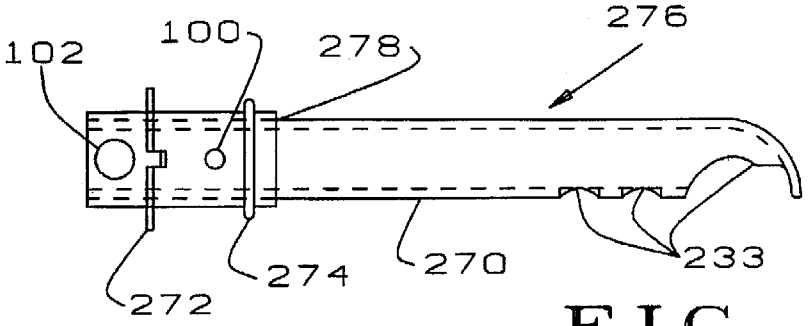
FIG. 5
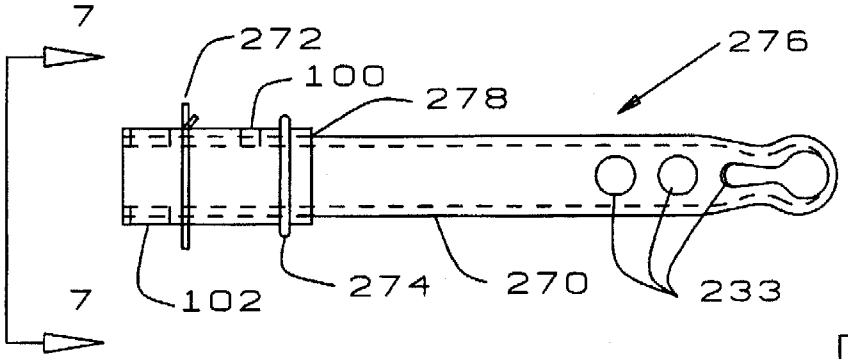
FIG. 6
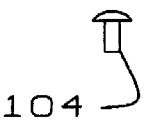
FIG. 7
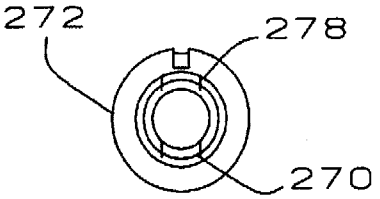
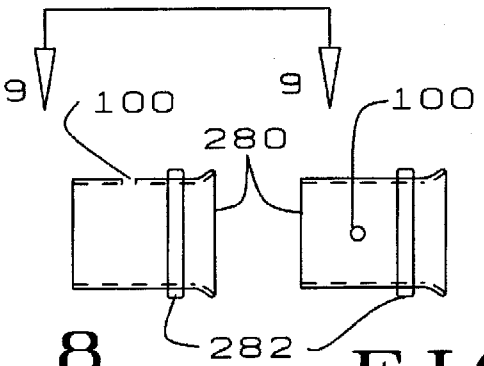
FIG. 8
FIG. 9

HOT WATER SYSTEM

This application is a continuation-in-part of U.S. application Ser. No. 08/394,967, filed Feb. 27, 1995 now abandoned.

BACKGROUND OF THE INVENTION

1. Field of the Invention

This invention relates to hot water plumbing systems and is particularly directed to improved hot water plumbing systems which ensure rapid provision of constant hot water without requiring pumps or other artificial delivery means.

2. Description of Related Art

It has long been standard practice to provide buildings with hot water plumbing systems to supply bathrooms, kitchens, and the like with hot water. Unfortunately, in most prior art hot water plumbing systems, the water heater is located a considerable distance from the location or locations to which the hot water is to be delivered and, between periods of use, the water sits in the piping between the hot water heater and the delivery spigot for significant periods of time, during which it becomes cold, even if the piping is insulated. When this occurs, a considerable quantity of water must be drawn off before the discharged water reaches a desired temperature. A substantial interval of time is usually required before the discharged water reaches the desired temperature, which creates significant loss of time for the person needing the hot water. Furthermore, the water which is drawn off is usually simply flushed down a drain and wasted, which significantly increases the cost of providing hot water. Also, in colder regions, the water standing in the pipes is subject to freezing, which frequently causes rupture of the pipes with attendant repair costs and possible expensive damage to adjacent ceilings, walls, and furnishings. To overcome these problems, some prior art hot water plumbing systems have included mechanical delivery means, such as pumps or the like, to accelerate the flow rate of the hot water to the delivery spigot. However, this significantly increases the cost of installation and maintenance of the hot water plumbing system. Another disadvantage of prior art hot water plumbing systems has been that the water in the water heater is stagnant during the intervals between usage and, hence, tends to cause sediment to accumulate in the bottom of the water heater which decreases the heater efficiency and, unless periodically removed, results in clogging of the system and corrosion of the heater. Thus, none of the prior art hot water plumbing systems have been entirely satisfactory.

OBJECTS AND SUMMARY OF THE INVENTION

These disadvantages of the prior art are overcome with the present invention, and an improved hot water plumbing system is provided which requires no mechanical delivery means, yet ensures immediate and constant delivery of hot water to any location in the plumbing system.

These advantages of the present invention are preferably attained by providing an improved hot water plumbing system comprising a water heater, a delivery location, a delivery line delivering water from said heater to said delivery location, a riser located adjacent said delivery location and extending upward above the level of said heater, and a return line connected adjacent the upper end of said riser and inclined so as to extend gradually downward to an input located adjacent the bottom of said heater to provide a continuous flow of hot water within the system, which ensures immediate and constant delivery of hot water to the delivery location and prevents accumulation of sediment within the system and, hence, minimizes installation and maintenance costs and significantly reduces the amount of waste water. Also, the additional plumbing adds to the capacity of the system.

Accordingly, it is an object of the present invention to provide an improved hot water plumbing system.

Another object of the present invention is to provide an improved hot water plumbing system which ensures immediate delivery of hot water to any desired delivery location.

An additional object of the present invention is to provide an improved hot water plumbing system which ensures constant delivery of hot water to any desired delivery location.

A further object of the present invention is to provide an improved hot water plumbing system which does not require the use of mechanical delivery means, such as pumps and the like.

Another object of the present invention is to provide an improved hot water plumbing system which does not allow sediment to settle in the system heater.

An additional object of the present invention is to provide an improved hot water plumbing system which minimizes the costs of installation and maintenance of the plumbing system.

A further object of the present invention is to provide an improved hot water plumbing system which minimizes the quantity of water wasted by the system.

Another object of the present invention is to prevent the hazards of frozen pipes in frigid areas.

A specific object of the present invention is to provide an improved hot water plumbing system comprising a water heater, a delivery location, a delivery line delivering water from said heater to said delivery location, a riser located adjacent said delivery location and extending upward above the level of said heater, and a return line connected adjacent the upper end of said riser and inclined so as to extend gradually downward to an input located adjacent the bottom of said heater to provide a continuous flow of hot water within the system, which ensures immediate and constant delivery of hot water to the delivery location and prevents accumulation of sediment within the system and, hence, minimizes installation and maintenance costs and significantly reduces the amount of waste water.

Particularly advantageous aspects of the invention include an adjustable vacuum accelerator to accelerate the water flow within the system and a heater tank cleaning probe which provides a means to clean the heater tank of sediment, thereby increasing heater efficiency. All functions of the system are independently adjustable to provide maximum efficiency for various types of installations and does so without moving parts. The adjustable vacuum accelerator utilizes water pressure within the system, and the adjustable feature permits the necessary adjustments to meet specific needs of various systems. The heater cleaning probe is effective at all times due to the convective action within the system.

Opening of any fixture within the system causes an accelerated flow of water through the system due to the vacuum accelerator and to the heater cleaning probe, depending on the setting of a three-way ball valve. When the accelerated flow passes through the heater cleaning probe, it causes an agitating or turbulent motion, and suspended sediment particles are driven upwardly to be discharged from the heater into the delivery line. The constant convective flow and the accelerated flow of the water through the entire system assures to maintain the cleanest possible entire system without the use of filters and the like. The heater cleaning probe may be used with or without the vacuum accelerator, and with or without a circulating loop.

The system disclosed hereinabove is reliable, dependable, economical, easy to install, and can be retrofitted to existing structures. It has no moving parts and is therefore maintenance-free and, above all, is environmentally conscious. All functions of the system are adjustable to meet design and consumer needs. For economic reasons many residential structures are designed and constructed on concrete slabs with the hot water plumbing system installed below the slab, which creates operational requirements not addressed by prior art systems, but which are addressed by the vacuum accelerator means of the subject invention. Once properly adjusted, the system is self-regulating to accommodate user demand and convenience.

For conservation purposes the preferred system design is not intended to provide instantaneous hot water at the delivery fixtures, but to provide a comfortable, warm, and then a hot water supply at the fixtures. The system will supply instantaneous hot water at the fixtures, but at the expense and waste of additional energy required to heat the water at the water heater to a much higher temperature than the actual temperature required by the user at the fixtures. The system thus provides for lower water heater temperature settings, thereby increasing efficiency, minimizing heat loss through design and insulating features and, for safety reasons, avoiding scalding temperatures within the system.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

FIG. 5 is a top view of a heater tank cleaning probe assembly;

FIG. 6 is a side view of the heater tank cleaning probe assembly of FIG. 5;

FIG. 7 is an end view of the heater tank cleaning probe assembly taken at 7—7 of FIG. 6;

FIG. 8 is a side view of the heater tank cleaning probe collar assembly;

FIG. 9 is a top view of the heater tank cleaning probe collar assembly taken at 9—9 of FIG. 8;

DETAILED DESCRIPTION OF THE PREFERRED EMBODIMENTS

The following description is provided to enable any person skilled in the an to make and use the invention and sets forth the best modes contemplated by the inventor of carrying out his invention. Various modifications, however, will remain readily apparent to those skilled in the art, since the generic principles of the present invention have been defined herein specifically to provide a particularly useful and readily installable hot water system.

Figure 1:
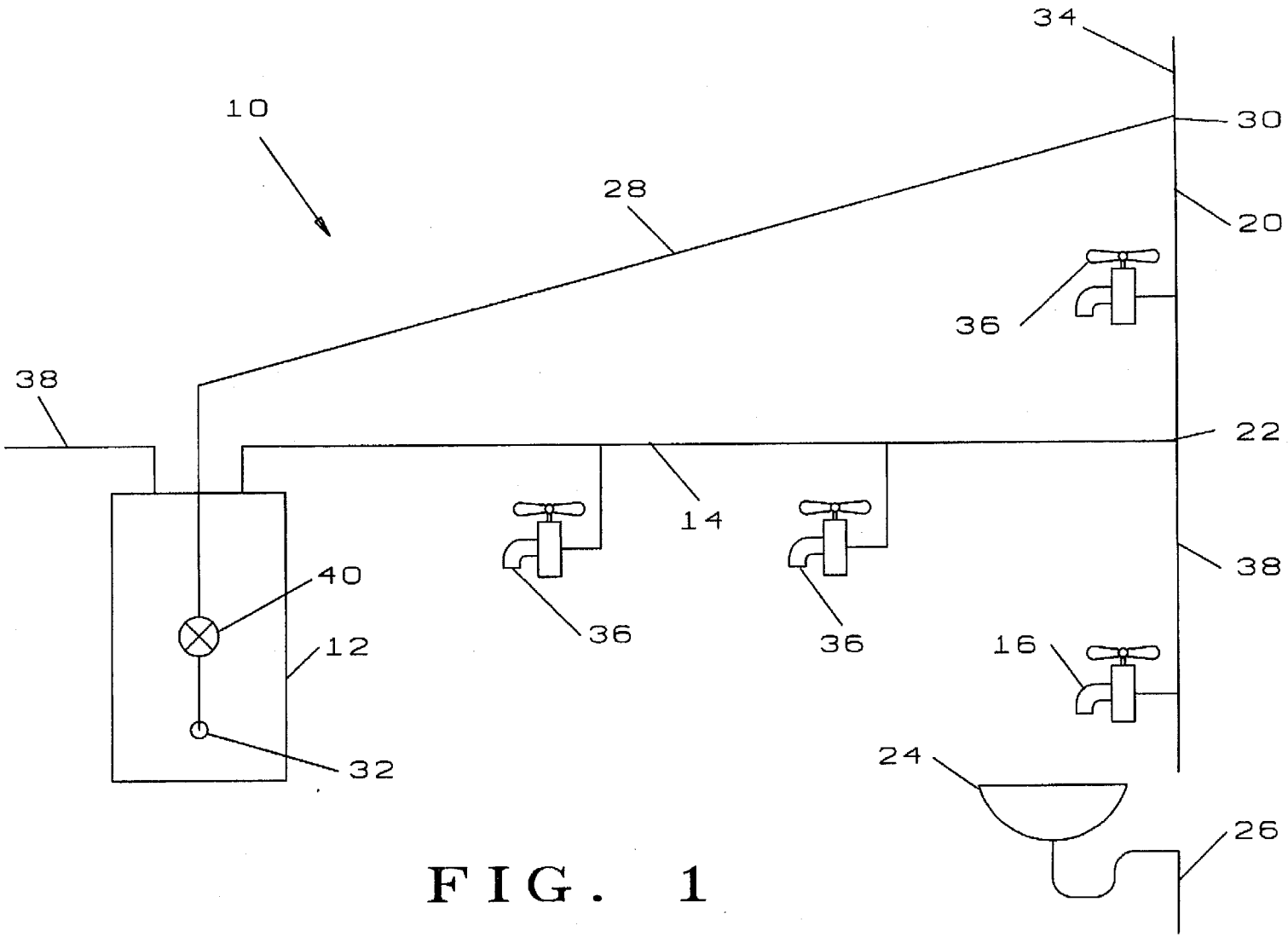
FIG. 1 is a diagrammatic representation of a hot water plumbing system according to a preferred embodiment.

In that form of the present invention chosen for purposes of illustration in the drawings, FIG. 1 shows a hot water plumbing system, indicated generally at 10, having a hot water heater 12, which may be conventional. The hot water heater 12 has a delivery line 14 connected to carry hot water from the heater 12 to a delivery location, such as spigots 16 and 36. The spigot 16 is connected to a delivery line 18, and the delivery line 18 is connected to a riser 20 above the spigot 16, as seen at 22. The spigot 16 delivers hot water to suitable means, such as a sink 24, which, when desired, discharges into a sewer 26 in a conventional manner. The riser 20 extends above the delivery line 14 to a height of approximately 34 inches above the top ceiling level, which is satisfactory for delivering hot water to a single story building or to the upper stories of a multistory structure, without requiring mechanical pumps or the like. As shown, a return line 28 is connected adjacent the upper end 30 of the riser 20 and declines gradually downward to an input 32 located adjacent the bottom of the water heater 12. The slope of the return line 28 must be such that gravity will tend to cause water in the return line 28 to flow downward to the input 32. An air gap is provided between points 30 and 34. Also if desired, additional hot water delivery locations may be provided by connecting to the delivery line 14 and the riser 20, as indicated by spigots 36, and the input 38 may be provided to allow water to be supplied to the water heater 12 from a suitable source (not shown) such as a well, municipal water line, or the like.

In use, as the water heater 12 heats the water, convection will cause the heated water to rise and to flow through the delivery line 14 to the riser 20 and upward within the riser 20. Also, since the return line 28 declines downwardly, gravity will tend to cause cooler water in the return line 28 to flow downward to the inlet 32 of the water heater 12, which will tend to create a vacuum adjacent the upper end 30 of the riser 20. However, atmospheric pressure on the water in the water heater 12 will force water to flow through the delivery line 14 and the riser 20 to prevent such a vacuum. Thus, water flow from the water heater 12 through the delivery line 14, the riser 20, and the return line 28 will occur due to the forces of physics, without requiring mechanical assistance such as pumps or the like. Since the upper end 30 of the riser 20 is farthest from the water heater 12, the water at the upper end 30 of the riser 20 will begin to cool in the system 10 and gravity will cause cooler water to flow through the return line 28 to the inlet 32 at the bottom of the water heater 12 for reheating. Consequently, all of the water within the water heater 12, the delivery line 14, the riser 20, and the return line 28 will gradually become heated to substantially the temperature provided by the heater 12 and will be constantly maintained at this temperature and will be continually available at the delivery locations 36 throughout the plumbing system 10. By connecting the delivery spigot 16 to the riser 20 at the connection point 22, below the delivery line 14, only that water situated in the portion 18 of the riser 20, between the connection point 22 and the spigot 16, will not be affected by the convective flow within the plumbing system 10. By minimizing the length of the portion 38, the spigot 16 will be able to provide an immediate and continuous supply of hot water to the sink 24. The spigot 16 can be opened to discharge any cool water contained in the portion 18 of the riser 20 and to allow any sediment which might accumulate to be discharged into the sewer 26. A flow control valve 40 is installed above the inlet 32 and serves to control the convective flow rate through lines 14, 20, and 28, at any flow rate at any setting within the range of from 0% to a flow rate of 100%, various settings being appropriate for various systems, depending on system design, heater temperature, and user needs. Commercially available valves are indexed, e.g. 1, 2, 3, 4, etc. to assist in setting, for example, at 0%, 25%, 50%, 75%, etc.

Figure 2:
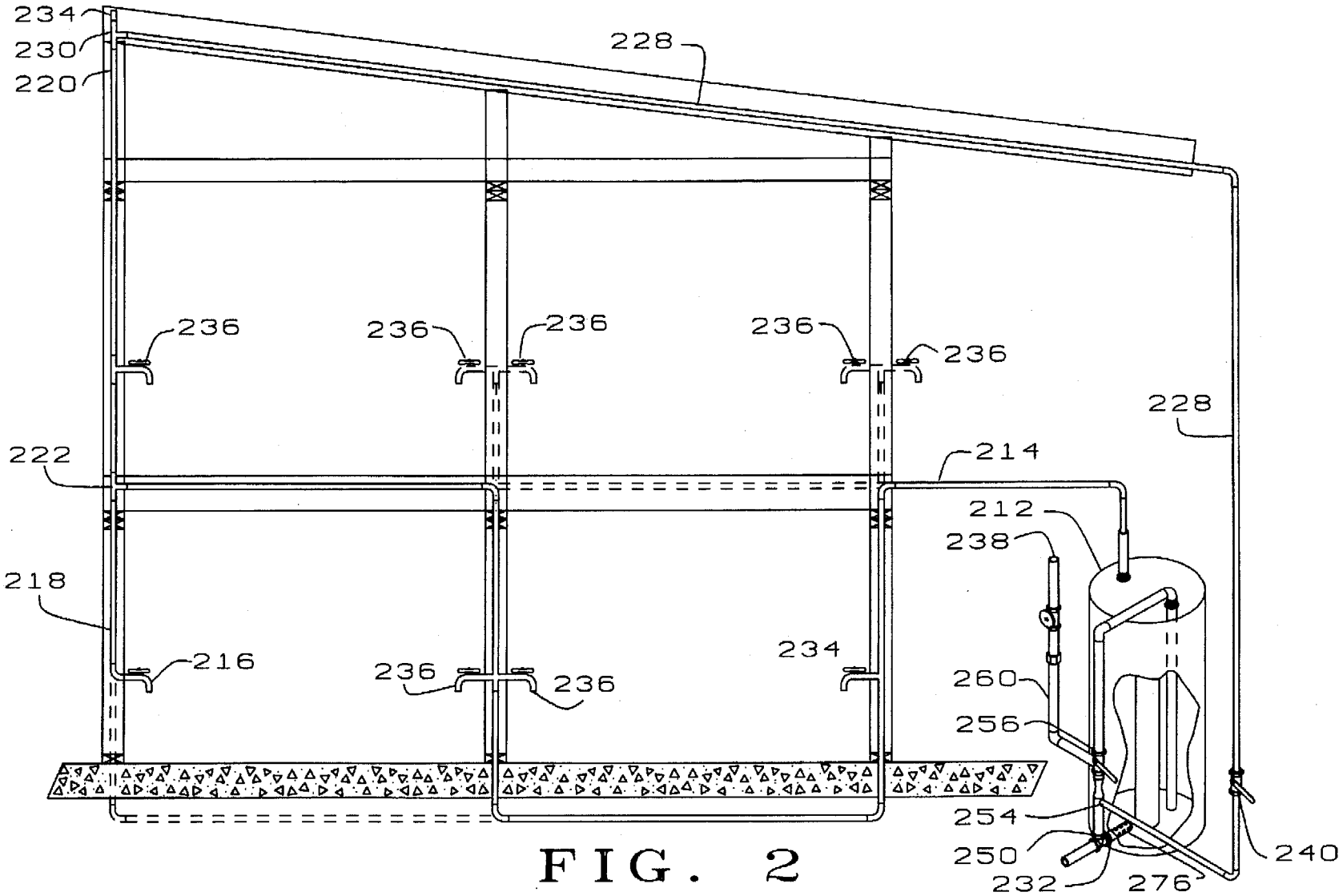
FIG. 2 is a pictorial representation of a convective vacuum-assisted hot water circulation system according to the preferred embodiment.

FIG. 2 illustrates a second convective circulation hot water plumbing system having a conventional water heater 212 and a delivery line 214 to provide water from the heater 212 to delivery locations such as fixtures 216, 234, and 236. Fixture 216 connects to the delivery line 218, which is connected to both the delivery line 214 and a riser line 220 at a tee 222. The fixture 216 delivers warm-to-hot water to units such as sinks, tubs, and the like and, when used, is discharged in a conventional manner.

The riser line 220 extends above the delivery line 214 to a second tee 230. A short line 234 is connected to, and extends above, the second tee 230 to provide an air gap. A return line 228 is connected to the second tee 230 and declines gradually and then vertically to a ball valve 240.

Figure 3:
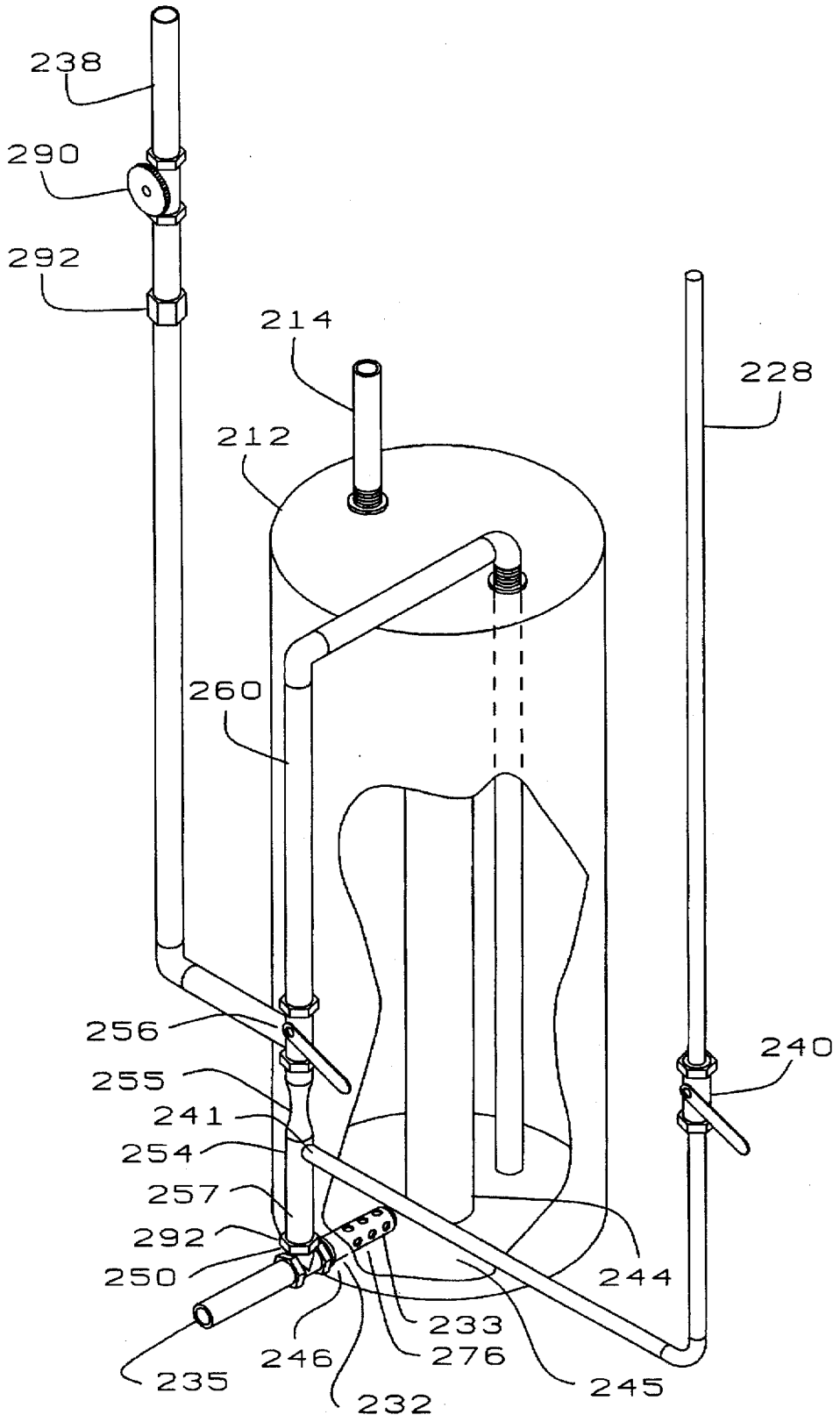
FIG. 3 is a three-dimensional drawing of the hot water heater of FIG. 2 and related components.

Referring to FIG. 3, the return line 228 continues from the ball valve 240 and is connected to the side port 241 of an adjustable vacuum accelerator unit 254. The adjustable vacuum accelerator unit 254 has a first end 255 connected to a three-way ball valve 256 and a second end 257 connected to one end of a dielectric union 292. The opposite end of the dielectric union 292 is connected to a tee 250. The tee 250 is connected to a nipple 246, which is, in turn, connected to the water heater tank port 232.

A heater cleaning probe 276 is inserted through the nipple 246, or the existing nipple on the water heater tank 212 at port 232, as shown in FIG. 3. Water enters the water heater 212 through the ports 233 in the heater cleaning probe 276, and the entering volume is determined by the adjustment of the three-way ball valve 256. Water supply from a conventional source enters a supply line 238, passes through a shutoff valve 290, and continues to the dielectric union 292 and to the three-way ball valve 256. Water is diverted by the three-way ball valve 256 to a fill line 260 or to the adjustable vacuum accelerator unit 254 or to both, depending on the system design and requirements.

The ball valve 240 may be an industry standard valve such as Part No. T-585-70 as manufactured by Nibco, meeting the temperature and pressure requirements of the particular application and controls the convective flow rate within the return line 228 by adjusting the ball valve 240 to the desired position. The three-way ball valve 256 may also be an industry standard valve such as Part No. AKTN No. 54, as manufactured by Kitz, meeting system requirements and controls the rate of flow from the supply line 238 by directing the supply water to the fill line 260 or to the adjustable vacuum accelerator unit 254, or both. According to test, a minimum flow rate of the water supply in the line 238 must pass through the adjustable vacuum accelerator unit 254 and through the cleaning probe 276 so that the adjustable vacuum accelerator unit 254 will produce a given amount of vacuum, if needed, and for the cleaning probe 276 to be effective in its accelerated stage (any fixture open). After this minimum flow rate is provided by adjustment of the three-way ball valve 256, the remaining balance of the flow rate in the supply line 238 is diverted to the fill line 260 by the three-way ball valve 256. Therefore, there is no restriction or reduction of the total flow rate to the water heater 212.

The most important feature of the three-way ball valve is the fact that the water supply from line 238 cannot be shut off or starve the water heater 212. Therefore, the supply line 238 must be connected to the side port of the three-way ball valve 256. Either end port of the three-way ball valve 256 may be connected to either the vacuum accelerator 254 or the fill line 260. The three-way ball valve 256 as shown in FIG. 3 would divert 100% of the flow to the vacuum accelerator 254. If the handle were in the down position, 100% of the flow would divert to fill line 260. Positioning of the handle between the 6 o'clock and 9 o'clock positions would divert the flow of water according to the position set, i.e. 0–100% to either unit, never 0% to both simultaneously.

It should be kept in mind that someone could tamper with these valves, especially small children. Further, building codes in many areas would not accept some methods that could be utilized. The above-disclosed method entirely eliminates any of the possible problems that could arise. The threeway ball valve 256 could be eliminated by installing a tee in its place and installing a valve between the tee and the vacuum accelerator 254. However, by doing so, the supply of water to the vacuum accelerator 254 would be limited to only 30% of the total flow rate from supply line 238. This amount is adequate for the cleaning probe 276, but it may not be sufficient for the operation of the vacuum accelerator 254 should the system require more vacuum. If the three-way ball valve 256 is inverted (rotated 180 degrees around its stem axis) to form that position shown in FIG. 3, the reading of the valve dial would reverse. Therefore, all settings of the three-way ball valve 256, when installed in the inverted position, would have to be compensated for accordingly. The arrow stamped on the handle of the three-way ball valve 256 always indicates direction of flow.

In the idle stage, with all fixtures closed, convective flow through the return line 228, as regulated by the ball valve 240, provides a constant circulation of the water within the system depending on the adjustment of the ball valve 240 and the temperature setting at the water heater 212. The alignment of the three-way ball valve 256 is important, so as not to starve the water heater. Adjustments of the three-way ball valve 256 may be at any preference; however, extremely high settings to the adjustable vacuum accelerator unit 254 and the heater cleaning probe 276 may become restrictive and noise may occur at the water heater 212. If noise presents no problem, so be it.

Further, it is important to install the three-way ball valve 256 and the adjustable vacuum accelerator unit 254 as near as possible to the horizontal plane of the heater tank port 232. By so doing, there is little or no reverse convective flow effect in the return line 228 or the supply line 238 during the idle stage. Room permitting, the adjustable vacuum accelerator unit 254 and the three-way ball valve 256 may be installed from 0 to 360 degrees around the axis 235 of the heater tank port 232. Additional fittings installed with respect to the nipple 246 will allow for a 360-degree installation. The adjustable vacuum accelerator unit 254 may be installed in any position.

Figure 4:
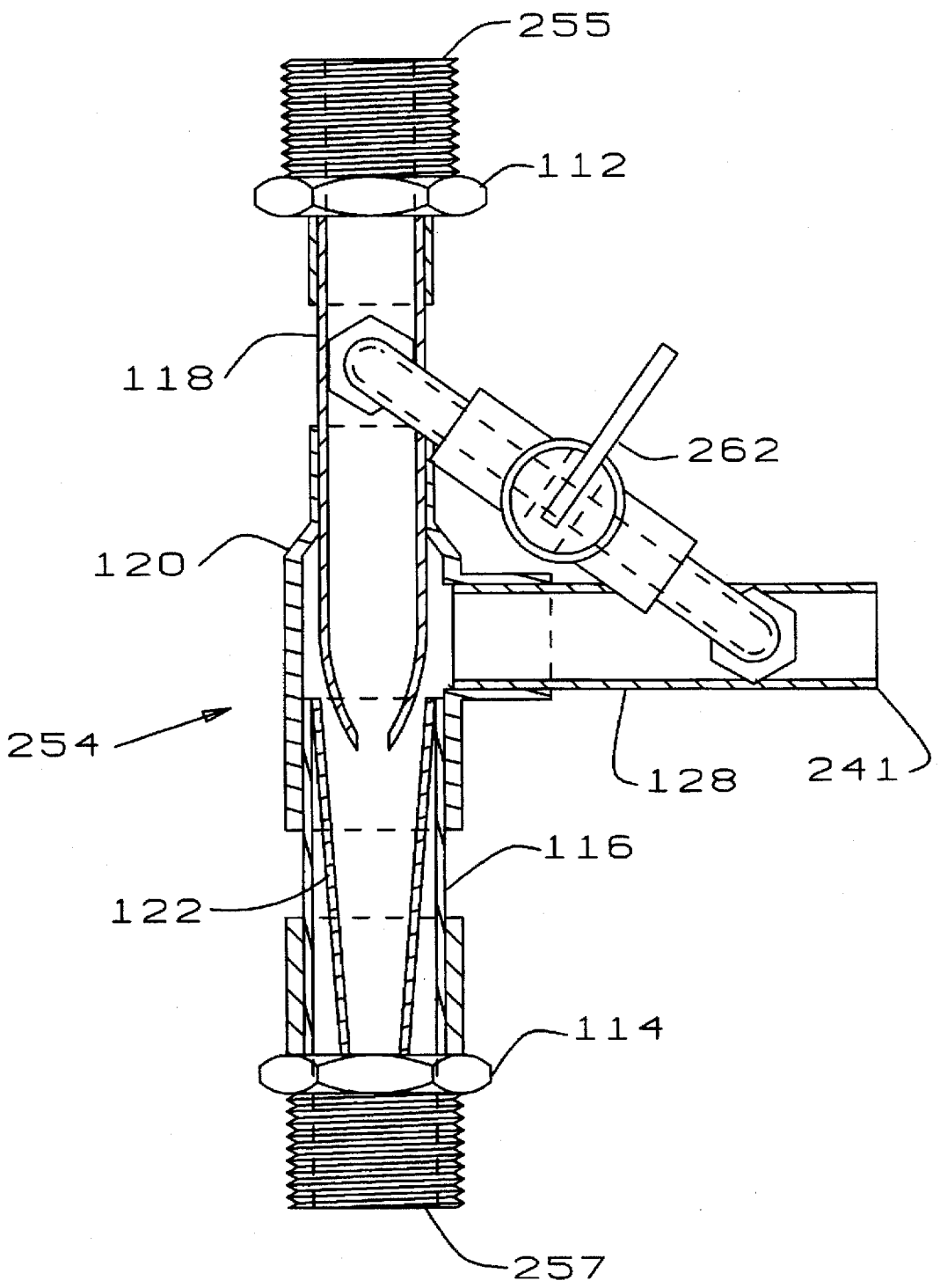
FIG. 4 is a sectional drawing of an adjustable vacuum accelerator unit.
Figure 11:
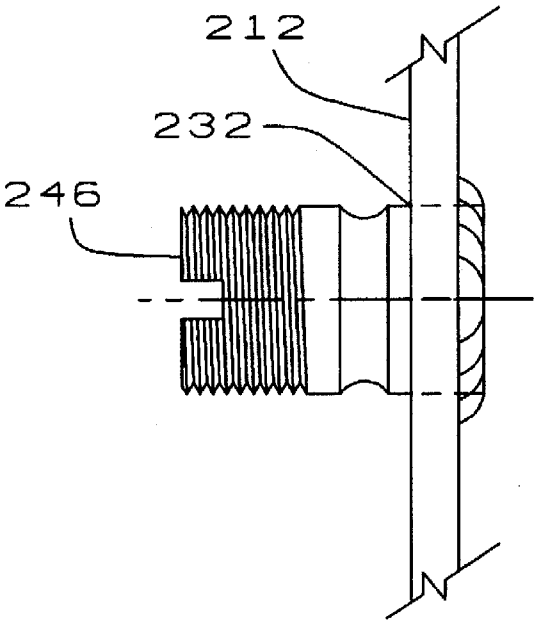
FIG. 11 is a side view of an existing nipple.
Figure 10:
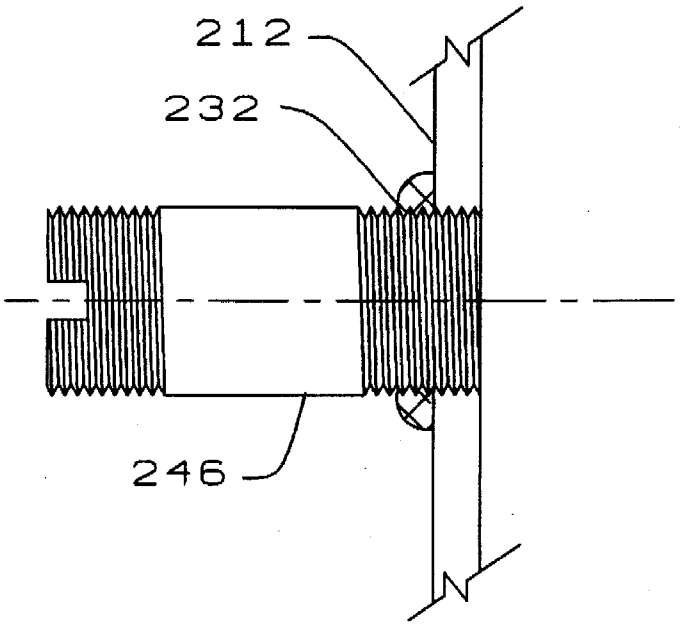
FIG. 10 is a side view of a replacement nipple.

FIG. 4 is a sectional view of the adjustable vacuum accelerator unit 254 and its cooperating control valve 262 which comprises a single unit. Water enters the adjustable vacuum accelerator unit 254 at a fitting 112, passes through an ejector 118, and is accelerated through a venturi 122, thereby creating a partial vacuum within a body fitting 120. Water exits the unit 254 at a fitting 114. A fitting 116 connects the body fitting 120 to the fitting 114.

When the control valve 262 is in the closed position shown in FIG. 4, the adjustable vacuum accelerator 254 functions at the maximum suction rate. Opening of the control valve 262 causes water to enter from an ejector 118 and pass through the control valve 262 and is discharged into fitting 128. By so doing, the pressure within ejector 118 is used to reduce or relieve the partial vacuum created in the body fitting 120 and fitting 128 connected thereto. As the water is discharged, the amount of draft or suction is reduced proportionately as control valve 262 is opened.

As may be appreciated, all structures and their plumbing systems vary. Referring again to FIG. 2, the phantom lines shown below the concrete slab indicate an extreme condition, which requires additional suction in the return line 228 to accelerate the flow throughout the system. The phantom lines shown at midlevel illustrate a minor condition and less suction would be required. Provision of the adjustable vacuum accelerator unit 254 enables meeting individual system needs by, for example, providing the increased suction necessary when pipes are below the slab, thereby increasing operating efficiency. Field adjustments of the entire system can thus be readily accomplished without tools and elaborate equipment. Once adjusted, the system proceeds to operate with no moving parts.

In a typical system start-up, the hot water heater temperature setting is set, for example, at "normal." In the absence of the vacuum accelerator 254, the system charges over a period of time and reaches a steady state. With the vacuum accelerator 254 in place, the system charges immediately. The amount of water passing through the accelerator 254 is adjusted to provide any required additional "pull," and the ball valve 240 is then adjusted to set the return loop. Initial settings can be achieved based on prior experience, as well as knowledge that increased vacuum will be needed for below-slab pumping. Control valve 240 may, for example, be initially set at 20% and then increased if necessary. As noted, the valves are preferably provided with faces having indexed values to facilitate setting.

Those systems that may not require vacuum to operate the system efficiently still benefit from its installation. Upon start-up of the system, the vacuum accelerator 254 will "prime" the entire system within minutes, whereas the natural effects of the system could take hours, thereby reducing the start-up time of the system considerably. To prime the system, the system is filled with water, and the heater has been allowed to reach a set temperature and has shut off. Any valve within the system is opened with the valve 262 on the vacuum accelerator 254 set in the closed position. Within seconds the lines 214, 220, and 228 are purged. Within several minutes, after the system settles, the entire system can be purged by opening each individual fixture to release any trapped air.

To expedite the draining of the system rapidly, a Schrader valve, manufactured by Pipco and other companies, may be installed above the ball valve 240. Opening of the heater drain valve and closing ball valve 240 and inducing air in the Schrader valve will cause the system to drain at a very rapid rate. The Schrader valve also serves to air pressure check the system after installation and prior to filling the system with water.

An in line thermostat or temperature flow regulation device, available through numerous manufacturers, can also be installed in line between ball valve 240 and point 228 in FIG. 2 or FIG. 3. Such a thermostat is used to restrict the flow in the return line 228. Such a thermostat would only assist in energy savings in those areas of extreme frigid temperatures when hot water volume is higher than normal, and is required for extended periods of time. Use of a thermostat does add a moving part to the system, however.

FIGS. 5–9 further illustrate the heater tank cleaning probe assembly 276. The heater tank cleaning probe assembly 276 consists of a stainless steel tube 270 having a number of ports 233 therein, as well as a bushing 278, a retainer 272, and "O" rings 274.

This assembly 276 allows passage of the water supply from the adjustable vacuum accelerator unit 254 to enter the water heater tank 212 at the port 232 as shown in FIG. 3. As the water enters the open end of the cleaning probe 276, it is disbursed through the ports 233 in the cleaning probe 276 at or near the bottom 245 of the water heater tank 212 in a manner which causes a sweeping upward lifting motion. The design of the cleaning probe 276, the conical design of the heater tank bottom and the flue 244 eliminates any vortexing effects at the tank bottom. The flow of water out of the cleaning probe 276 is designed so as not to overexcite the temperature control of the water heater 212. As the sweeping, upward lifting motion continues within the water heater tank 212, the sediment within the tank 212 is suspended and elevated toward the top of the tank and eventually discharged from the tank 212 through the delivery line 214. Configurations and shape of the heater cleaning probe 276 will vary due to different heater tank configurations, while conforming to the principles and teachings herein.

Installation of the cleaning probe 276 in an illustrative embodiment is accomplished by removing the water heater drain valve at the port 232. After removal of the drain valve, one of two connections are available, either a male threaded nipple or a female port, depending on the type of drain valve removed. If a male nipple exists, a slot is cut with a file at the 12 o'clock position of the existing nipple for right-hand flow, or a notch is cut at the 6 o'clock position for left-hand flow, depending on the location of the water heater sensor. The flow is always directed away from the heater sensor. Proper "O" rings are installed on the bushing 278 and the probe assembly 276 is inserted with the notch in the retainer 272 mating with the notch cut in the existing nipple 246. The cleaning probe 276 will insert with thumb pressure and may be aligned using the holes 102 at the open end of the cleaning probe 276. The retainer flange 272 is now flush with the existing nipple 246. Female threads of various fittings are selected from, i.e., a tee, elbow, or union. When installed, the outer edge of the retainer flange 272 becomes part of the integral threads between the fitting and the nipple 246, thereby locking the heater cleaning probe 276 in place. This locking feature is due to the tapered threads of the fitting being fitted over the nipple 246, and flange 272 becomes interlocked between the threads of nipple 246 and the fitting being installed. If a female port exists after removal of the water heater drain valve, the same installation procedures apply, except the nipple 246 must be installed into the tank port at 232. To accommodate the size of the nipple 246, the collar 280 and the "O" ring 282 (FIGS. 8, 9) are placed over and onto the cleaning probe bushing 278. The holes at 100 are aligned and the pin 104 is inserted to lock the units together. When inserted into the nipple 246, the locking pin 104 is secured. The installation is completed as previously mentioned.

Referring again to FIG. 2, tests indicate that systems having a higher than normal sediment content may cause sediment to collect in line 218 or in any line installed below point 222 and near or below the riser 220. Periodic use of the fixture 216 is recommended to flush any sediment collected therein. It is also recommended that the fixture 216 at this point be of the nonrestrictive flow type. A plumbing trap may be utilized to retain minor particles of sediment from the return line 228. If installed near and below the heater tank port 232, periodic flushing of the heater drain valve installed below the heater tank port 232 provides a convenient method to discharge any collected sediment. Since any practical plumbing installation may be used, it is therefore unlimited as to the method utilized to avoid recirculating of the sediment within the system.

Referring again to FIGS. 3 and 4, the heater tank cleaning probe assembly 276 may be used without a convective vacuum return system in various hot water heater systems other than the convective system shown in FIG. 2. Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. The hot water plumbing system of claim 8 further comprising:

a supply line having a first end;

a fill line having a first end connected to said water heater and a second end;

means having an inlet end, an outlet end, and a side port for generating a partial vacuum between said inlet and said outlet end and for adjusting the strength of said partial vacuum;

means for regulating flow of water from said supply line to said means for generating a partial vacuum, said means for regulating having a first inlet connected to the first end of said supply line, said means for regulating further having first and second outlets, said first outlet being connected to the second end of said fill line, said second outlet being connected to said inlet end of said means for creating a partial vacuum; and means for connecting the outlet end of said means for creating a partial vacuum to an inlet to said water heater and for connecting said side port of said means for creating a partial vacuum to said return line.

2. The apparatus of claim 1 wherein said means for connecting includes a heater tank cleaning means.

3. The apparatus of claim 2 wherein said heater tank cleaning means comprises a tube extending into said water heater adjacent the bottom of said heater, said tube having a number of ports therein.

4. The apparatus of claim 1 wherein said means for connecting includes a first return line portion, a second return line portion connected at one end to said side port, and a valve means connected between said first return line portion and said second return line portion for regulating the flow therebetween.

5. The apparatus of claim 1 further including:

a riser having an upper end and a lower end connected adjacent its lower end to said delivery line;

a return line connected adjacent the upper end of said riser and inclining downward to an input located adjacent the bottom end of said heater; and means for utilizing hot water from said plumbing system.

6. The apparatus of claim 1 wherein said means for regulating flow to said means for creating a partial vacuum comprises a three-way ball valve.

7. The apparatus of claim 1 wherein said means for regulating flow to said means for creating a partial vacuum comprises a tee fitting and a valve connected thereto.

8. A hot water plumbing system comprising:

a hot water heater;

a delivery line having one end connected to said heater;

a riser having an upper end and having a lower end connected adjacent its lower end to said delivery line;

a return line connected adjacent the upper end of said riser and inclined so as to extend gradually downward at an angle sufficient to cause continuous water circulation through said system due to gravity to an input connected adjacent the bottom end of said heater; and means for utilizing hot water from said plumbing system.

9. The plumbing system of claim 8 wherein said means for utilizing hot water is a spigot.

10. The plumbing system of claim 8 wherein said return line inclines downward at an angle sufficient to cause gravity flow of water through said return line.

11. The plumbing system of claim 8 wherein said means for utilizing hot water is connected to said delivery line.

12. The plumbing system of claim 8 wherein said means for utilizing hot water is connected to said riser.

13. The plumbing system of claim 8 wherein said means for utilizing hot water is connected to said return line.

14. The plumbing system of claim 8 wherein a plurality of utilizing means are connected to said system.

15. The plumbing system of claim 8 wherein said riser extends above said delivery line to a height of not more than 34 inches.

16. The plumbing system of claim 8 wherein said means for controlling comprises a flow control valve connected to regulate the convective flow rate through said system.

17. The plumbing system of claim 16 wherein said flow control valve is connected in said return line adjacent said input to said heater.

18. The hot water plumbing system of claim 8 further comprising:

vacuum accelerator means for generating a vacuum for accelerating fluid flow in said system.

19. The system of claim 18 wherein said vacuum accelerator means comprises a body portion having first and second ends and a venturi located therein.

20. The system of claim 18 wherein said vacuum accelerator means further includes control means for controlling the amount of suction produced by said vacuum accelerator means.

21. The hot water plumbing system of claim 8 further comprising:

a supply line having a first end;

a fill line having a first end connected to said water heater and a second end; and a three-way valve means having a first inlet connected to the first end of said supply line, a first outlet connected to the second end of said fill line, and a second outlet end means for supplying water for provision to a second fill line to said heater.

22. The hot water plumbing system of claim 8 further comprising:

a vacuum accelerator means for accelerating fluid flow in said system, said accelerator having a body portion;

a venturi located therein; and control means for adjusting the amount of suction produced thereby.

23. In the hot water heating system of claim 8, the apparatus comprising:

said hot water tank having a bottom;

a heater cleaning probe located adjacent the bottom of said tank comprising a cylindrical tube having an axis and a forward end inclined with respect to said axis to divert the flow of water through said tube and at least one port for causing the water from said tube to be discharged at an angle to said axis, and means external to said heater for adjusting the orientation of said port.

24. The hot water plumbing system of claim 8 further comprising:

means for controlling the rate of fluid flow through said system over a range from 0 to 100%.

25. The hot water plumbing system of claim 8 further comprising:

vacuum accelerator means for generating a vacuum for accelerating fluid flow in said system.

* * * * *